United States Patent [19]

Paris

[11] Patent Number: 4,583,306

[45] Date of Patent: Apr. 22, 1986

[54] ALPINE SKI BOOT

[75] Inventor: Jean Paris, Saint-Jorioz, France

[73] Assignee: Salomon S.A., Annecy, France

[21] Appl. No.: 662,500

[22] Filed: Oct. 19, 1984

[30] Foreign Application Priority Data

Oct. 19, 1983 [FR] France ..... 83 17107

[51] Int. Cl.[4] ..... A43B 5/04

[52] U.S. Cl. ..... 36/119; 36/120; 36/121

[58] Field of Search ..... 36/117, 118, 119, 120, 36/121

[56] References Cited

U.S. PATENT DOCUMENTS

| | | | |
|---|---|---|---|
| 3,372,495 | 3/1968 | Finn | 36/119 |
| 3,561,139 | 2/1971 | Stillman | 36/119 |
| 4,222,184 | 9/1980 | Kastinger | 36/121 |
| 4,494,324 | 1/1985 | Spademan | 36/120 X |

FOREIGN PATENT DOCUMENTS

| | | | |
|---|---|---|---|
| 1817978 | 4/1976 | Fed. Rep. of Germany | 36/120 |
| 3201702 | 9/1982 | Fed. Rep. of Germany | 36/119 |
| 2371162 | 6/1978 | France . | |
| 2433311 | 4/1980 | France | 36/121 |
| 2514621 | 4/1983 | France . | |

*Primary Examiner*—Louis K. Rimrodt

*Attorney, Agent, or Firm*—Sandler & Greenblum

[57] ABSTRACT

A ski boot having a flexion zone and a bottom portion which is adapted to hold a boot therein. The boot includes a holding device for producing a force for holding the foot at the bottom of the boot. The boot also includes a distribution device for distributing the force over the foot. The distribution device includes at least two flexible and elastic overlapping portions. These overlapping portions extend over the flexion zone of the boot and the foot, as does the holding device. In one embodiment the overlapping portions are petal-shaped so as to better conform to the shape of the flexion zone of the foot. As a result of this structure, the distribution device can be adapted to conform to all morphologies of the foot.

58 Claims, 13 Drawing Figures

FIG. 5.
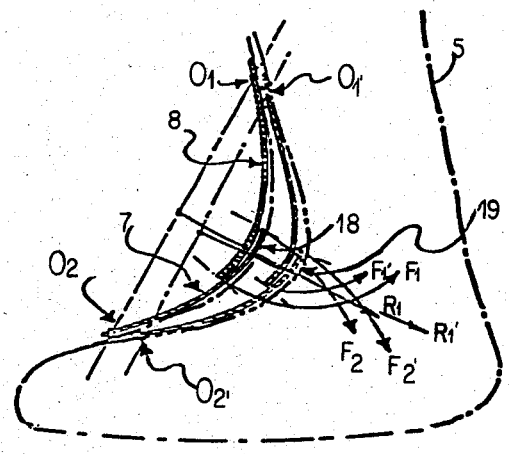
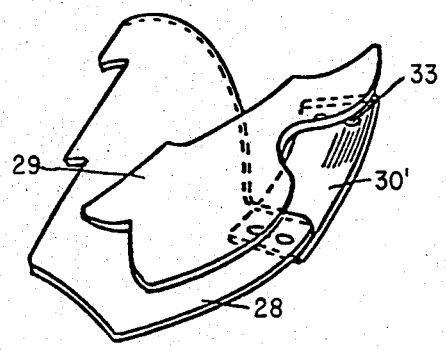
FIG. 8.

ALPINE SKI BOOT

BACKGROUND OF THE INVENTION

1. Field of the Invention

The present application relates to ski boots having a molded shell base surrounding the foot and an upper surrounding the lower portion of the leg. The upper comprises one or several portions of which at least one is journalled on the shell base.

2. Description of Pertinent Information

One common type of ski boot comprises a molded shell base and an upper. The shell base surrounds the foot and the upper surrounds the lower portion of the leg. The upper comprises one or several portions. At least one of these portions is journalled to the shell base.

This type of boot is relatively rigid and undeformable. Some manufacturers add an internal retention means for retaining the foot in the boot which do not require the deformation of the inner walls of the shell base.

Typical examples of these types of boots have already been described in various patents where the internal maintenance of the foot in the boot is accomplished, for example, by a support plate mounted inside the shell base. These types of support plates include adjustment means (e.g., screw-nut) which are accessible from the outside. In contrast, in products sold on the market by applicant, the maintenance of the foot in the boot is accomplished by a distribution plate adapted to cover the top of the foot and to press thereagainst under the effect of a traction cable. The plate and cable hold the foot in the boot by blocking the movement of the heel in the boot.

These means for maintaining the foot in the boot, however, have a number of disadvantages. In the first example discussed above, the tightening of the foot in the boot is localized on the uppermost bone of the top of the foot causing discomfort to the wearer. This discomfort is aggravated by the two vertical control screws whose ends are furnished with spheres which create, during adjustment, pinpoint pressure points on the foot.

In the second example discussed above, the internal tightening system comprising the distribution plate is not completely satisfying to the skier because the anatomical form of said distribution plate is not necessarily adapted to the innumerable types of morphology of the feet of different skiers. For example, in certain people in which the curve of the flexion zone of the foot (between the lateral and medial malleolus) is not very pronounced, what is called a "cord" effect by specialists is produced. This "cord" effect is the result of the traction cable leaving an impression on the foot of the skier. In addition, in other people the curve of the flexion zone of the foot is is too pronounced. As a result, the upper and lower edges of said plate are impressed into the skin of the skier. Such shortcomings are detrimental to the comfort of the skier who can not utilize the boot in an optimal manner. Thus, there is a need for a ski boot that does not suffer these disadvantages.

SUMMARY OF THE INVENTION

The present invention has as its goal to overcome such inconveniences by proposing a new type of distribution plate which can be adapted to all morphologies of the foot of skiers at the level of the ankle or the flexion zone and thus does not produce the "cord" effect or painful linear and pinpoint contact points.

To achieve this objective, the present invention comprises a ski boot provided with a device for distributing the internal tightening forces of the foot having an anatomical form which extends at least partially from the instep to the flexion zone of the foot. The instep is defined as that portion of the foot in front of the ankle or flexion portion of the foot. This device for distributing the internal tightening forces on the foot cooperates with at least one tightening element exerting a force to retain the foot at the bottom of the boot. The distribution device comprises at least two portions of at least one plate which overlap one another in the zone corresponding to the flexion zone of the foot. In addition, the tightening element acts on the smallest edge of said ankle or the flexion zone.

This distribution device preferably permits an almost perfect adaptation of the plate portions to the morphology of the flexion zone by virtue of flexion zones which are disposed on each portion of the plate and the ability of each plate to slide relative to the other plates under the action of the tightening element. This sliding movement increases the flexion of the plates.

According to various embodiments, the portions of the plates comprising the distribution device can be part of a single distribution plate or part of several separate overlapping plates. The tightening element can be of the type producing a traction force or of the type producing a compression force.

The invention thus has as its object to provide a ski boot in which the distribution device for the internal tightening of the foot can be adapted to all morphologies of the instep and the flexion zone of the foot which are different for individuals having the same shoe size, while simultaneously ensuring a holding of the foot at the bottom of the boot which is comfortable and effective without having to replace elements whose contour does not correspond to the anatomy of each individual.

According to another embodiment of the present invention, the invention comprises a ski boot having a bottom and which is adapted to hold a foot therein. The boot comprises a holding means for producing a force for holding the foot at the bottom of the boot, and distribution means for distributing this force over the foot. The distribution means comprises at least two overlapping portions.

The boot further comprises an instep zone and a flexion zone. The distribution means extends at least partially from the instep zone to the flexion zone of the boot. In addition, the boot is adapted to hold the foot having a flexion zone. In this embodiment, the at least two portions of the distribution means overlap above the flexion zone of the foot and the boot. In addition, these overlapping portions may be flexible and elastic. Furthermore, these overlapping portions are sufficiently flexible so as to comprise means for substantially conforming to the shape of the foot in response to the force from the holding means being applied to the distribution means.

In another embodiment, the boot further comprises an inner boot and having an outer surface, and an outer boot. The overlapping portions of the distribution means are positioned on the outer surface of the inner boot. In addition, the boot is adapted to accompany feet of different anatomical shapes. To accomplish this, the inner boot further comprises a flexible wall on which the outer surface of this inner boot is positioned. This flexible wall is sufficiently thick so that the flexible wall comprises means for compensating for feet having different anatomical shapes in response to the force being applied to the distribution means.

In still another embodiment, the distribution means comprises at least one plate. In an embodiment having one plate, each overlapping portion is on this one plate. Alternatively there may be two plates. In this case, each plate includes one of the overlapping portions.

In another embodiment, the holding means comprises a means for selectively applying the force for holding the foot at the bottom of the boot to the distribution means. In addition, this holding means may comprise a means for tightening the foot in the boot. This tightening means may apply the force on the overlapping portions over the flexion zone of the boot.

In another embodiment, the tightening means comprises a traction means. This traction means may, for example, be a cable, or strap. In addition, the boot further comprises a shell base, and the tightening means comprises a compression means comprising an inflatable chamber positioned between the overlapping portions and the shell base. Alternatively, the tightening means comprises a first tightening element positioned over the flexion zone of the boot and the second tightening element positioned over the instep of the boot, in front of the first tightening element.

In an alternative embodiment, the distribution means comprises a first plate and a second plate. The first plate comprises one of the overlapping portions and the second plate comprises the other of the overlapping portions. The first plate may be integral with one of the overlapping portions of the second plate and may also be integral with the other of the overlapping portions.

In still another embodiment, the boot comprises an upper for covering the leg, and a base for covering the foot. In this embodiment, the first plate is connected at a point on the upper and the second plate is connected to at a point on the base. The upper may comprise a cuff having an upper zone and the base may comprise an end zone at one end of the boot so that the first plate is connected to the upper zone of the cuff and the second plate is connected to the base in the end zone thereof. In addition, the first plate may comprise an upper plate and the second plate may comprise a lower plate. In one embodiment, the upper plate overlaps the lower plate at least partially on top of the lower plate. Alternatively, the second plate overlaps the first plate at least partially on top of the first plate.

In still another embodiment, the boot comprises an outer boot and an inner boot, such that the plates are connected to the inner boot. Alternatively, the boot may comprise a cuff having an inner wall, where the plates are connected to the inner wall of the cuff. In one embodiment, the plates a clipped to be boot by a pressure-type bottom. Alternatively, at least one plate may comprise a rack, and the boot may comprise a rack which is adapted to engage the rack of the plate so that each plate is connected to the boot by engagement of the rack of the boot with the rack of the plate.

In still another embodiment, the tightening means is adapted to be tightened and the overlapping portions are adapted to be displaced substantially freey over each other in response to tightening of the tightening means. In addition, at least one plate is attached to the boot at an attachment point and the plate flexes around its attachment point in response to tightening of the tightening means. The overlapping portions may be petal-shaped and the plates may further comprise at least one lateral wing. As a result of the structure of the overlapping portions and plates, the resultant of the force produced by the tightening means passes through the flexion zone of the foot and is substantially perpendicular to the surfaces of the overlapping portions.

In another embodiment, the distribution means comprises a single plate. These overlapping portions are integral with the single plate. The plate comprises a transverse opening which defines the overlapping portions, each of which are adjacent to the opening. In this embodiment, the boot comprises a cuff having an upper zone and a base having and end zone. In addition, the plate comprises an upper end and a lower end. The upper end of the plate is connected at a point to the upper zone of the cuff and the lower end of the plate is connected at a point on the end zone of the base.

Furthermore, the upper and lower end of the plates comprise a longitudinal slot. A connection means is adapted to pass through the longitudinal slot to connect the plate with the boot. The connection means is adapted to attach the plate to the boot at any point along the length of the longitudinal slot, whereby the plate is adapted to be displaced along the length of the slot.

The boot may further comprise two flexible connection elements each of which is disposed on one side of the transverse opening. Each connection element connects each of the overlapping portions to the other. In addition, the connection elements comprise means for ensuring sliding of the overlapping portions over each other in response to tightening of the tightening means. Also, the connection elements may comprise a notch therein.

In still another embodiment, the boot comprises an upper part and a lower part. In this embodiment, the distribution means comprises three separate support plates, comprising an upper plate positioned on the upper part of the boot, a lower plate positioned in the lower part of the boot, and an intermediate plate. The upper plate overlaps the intermediate plate to form a first covering zone which comprises the overlap between the upper and the intermediate plates. The intermediate plate also overlaps the lower plate to form a second covering zone comprising the overlap between the intermediate and the lower plate. The lower plate is positioned above the intermediate plate and the intermediate plate is positioned above the upper plate in one embodiment. In still another embodiment, the lower plate is positioned above the intermediate plate. Alternatively, the intermediate plate can be positioned above the upper and lower plate.

The intermediate plate may comprise a lower end and an upper end. The lower end of the intermediate plate is connected to the lower plate by connection means. This connection means comprises means for adjusting the position of the intermediate plate along the longitudinal axis of the boot. In addition, the upper end of the intermediate plate is adapted to be substantially freely displaced over the upper plate.

In still another embodiment, the boot further comprises means for connecting the intermediate plate to the upper plate and means for connecting the intermediate plate to the lower plate. Both connection means comprise means for adjusting the position of the intermediate plate with respect to the longitudinal axis of the boot. The connection means for the upper and lower plates comprise, slits in the upper and lower plate, respectively.

In addition, the intermediate plate may be mounted for substantially free movement on top of the upper and lower plates. In this embodiment, the intermediate plate may be integral with the tightening means. In addition, the boot may further comprise connection means for connecting the intermediate plate with the tightening means. This connection means for connecting the intermediate plate with the tightening means may comprise a loop on the intermediate plate on which the tightening means is adapted to pass.

The tightening means may comprise means for connecting the distribution plate with the boot. Alternatively, the distribution means may be connected to the external wall of the inner boot or the internal wall of the shell base. In another embodiment, the distribution means is connected to the boot at a plurality of connection points. This distribution means comprises adjustment slits which comprise the plurality of connection points. The slits comprise means for permitting the distribution means to be displaced along the longitudinal axis of the boot and the foot.

In still another embodiment, the distribution means is adapted to be in an initial position in which the force from the holding means is zero. In addition, the distribution means is adapted to be in a working position in which the force produced by the holding means is greater than zero. The boot further comprises means for connecting the boot with the distribution means. In addition, the connecting means comprises an elastic return means for returning the plate and the overlapping portions to their initial position when the tightening force ceases after having a value of greater than zero.

In each of these embodiments discussed above, the overlapping portions may comprise a notch structure in a form of a petal and each plate may comprise flexible lateral wings on each lateral side of the foot. Also, the plate may comprise flexible slits for insuring flexibility of the plate and maintaining a peripheral rigidity of the plate, and the distribution means may comprise a lower and an upper plate. The lower plate may comprise a V-shaped notch adapted to permit the boot to accommodate feet of different widths. Also, the support plate may be composed of plastic material which is flexible and elastic. In addition, the distribution means, when it comprises and upper and lower plate may be such that the radius of curvature of one of the plates is greater than the radius of curvature of the other of the plates so that a covering space is produced between the portions. In a preferred embodiment, the overlapping portion of the upper plate is above and covers the overlapping portion of the lower plate.

BRIEF DESCRIPTION OF THE DRAWINGS

The characteristics of the invention will be better understood with respect to the following description given by way of nonlimiting example and referring to the attached drawings in which:

FIG. 5 shows a diagram of the functioning of the distribution device according to the present invention for two curves of the flexion zone which are different from one another;

FIGS. 7 and 8 illustrate a perspective view of a distribution device for the interior maintenance forces of the foot comprising a single distribution plate having two distinct and separate support plate portions;

DETAILED DESCRIPTION OF PREFERRED EMBODIMENTS

Figure 1:
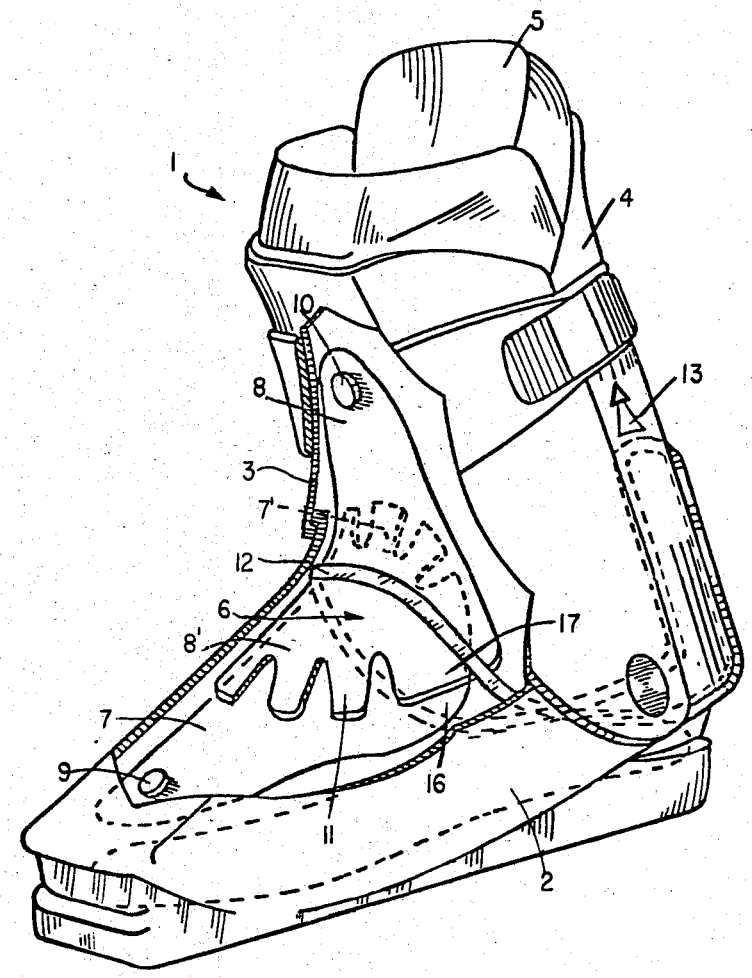
FIG. 1 is a perspective view of a ski boot according to the invention.

FIGS. 1 through 6 illustrate a boot 1 according to the invention of the rear entry type. It comprises a rigid shell base 2 on which is mounted a cuff 3 journalled on shell base 2 permitting flexion, while a rear spoiler 4 closes on the lower portion of the leg of the skier. An inner padded boot 5 is provided for ensuring the comfortable enveloping of the foot in the shell base.

Figure 3:
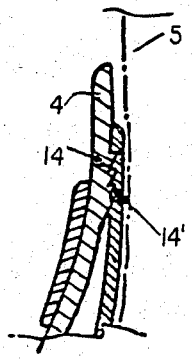
FIGS. 3 and 4 illustrate various connection means for the plates with the boot.
Figure 2:
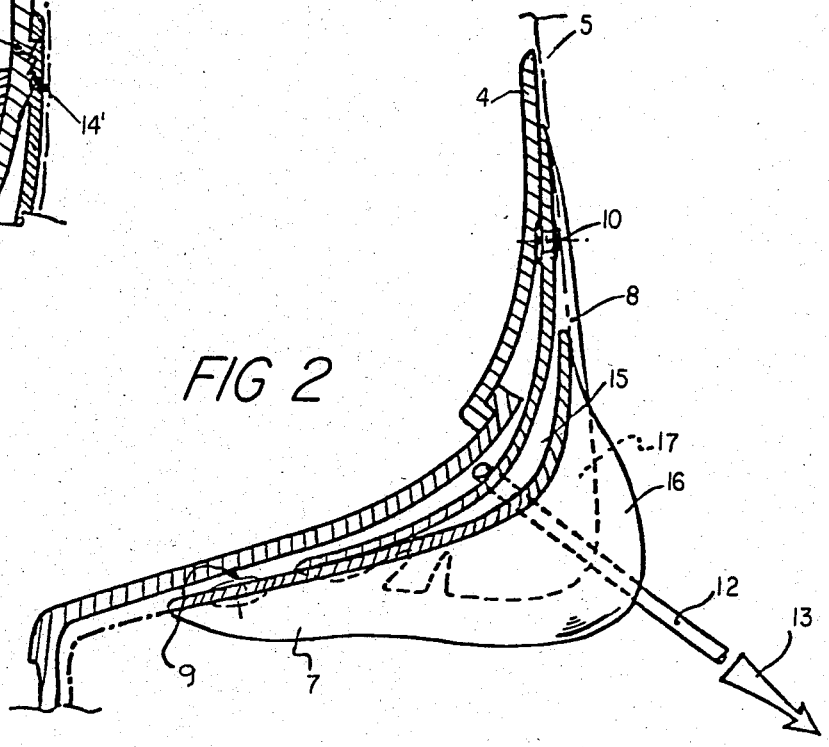
FIG. 2 is a partial cross-sectional view of the boot according to FIG. 1, the distribution device being in the rest position in which the traction cable has not been tightened.
Figure 4:
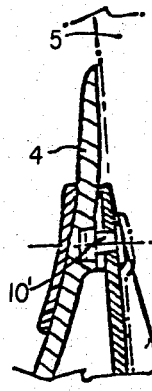

A distribution system 6 is disposed on the top of the inner boot for distributing the inner tightening forces produced by a holding means for holding the foot on the bottom of the boot. Distribution system 6 comprises at least two overlapping portions. In one embodiment seen in FIG. 6 distribution system 6 comprises two support plates 7, 8 having an anatomical shape which partially overlap each other and which extend at least partially from the instep zone to the flexion zone of the boot and foot. The overlapping portions are flexible and elastic, as can be entire plates 7 and 8. Plate 7 is a lower plate and plate 8 is an upper plate. These two plates 7, 8 are each connected to the outer wall of inner boot 5 at an attachment point. The attachment point for upper plate 8 is located at the anterior portion of the lower leg. The attachment point for lower plate 7 is located at the forward portion of the foot. More specifically, plate 8 may be attached to the upper zone of the cuff and late 7 can be attached to the forward end zone of the base of the boot. These attachments for plates 7 and 8 are provided by connection means 9, 10, respectively, such that they do not create any annoying protuberances which could cause discomfort for the wearer. Such connection means are illustrated in FIGS. 2 through 4 where several embodiments are shown. In FIG. 2 it should be noted that plates 7, 8 are clipped at 9, 10, respectively, on a pressure-type button located on the outer wall of inner boot 5 itself, while FIGS. 3 and 4 illustrate two embodiments for attaching plates 7 and 8 on the inner wall of the cuff of the boot, either by clipping (FIG. 4) as described above or by racks 14, 14' respectively located on the inner wall of the cuff and on the plate (FIG. 3). Alternatively, plates 7 and/or 8 can be connected to the inner wall of shell base 2.

Such an embodiment preferably allows height adjustment of the upper support plate by relative displacement of the notches on racks 14 and 14'. Of course it is within the scope of the invention to provide other adjustment means for this attachment of the plate on the inner boot or on the cuff which are illustrated, for example, in FIG. 9, to be discussed below. Although it is not illustrated for purposes of simplifying in the drawings, it is evident that the same type of attachment as those illustrated in FIGS. 3 and 4 can also be used between the lower support plate 7 and the shell base 2.

According to one characteristic of the invention, plates 7 and 8 comprise free end portions 7', 8'; respectively. Free end portions 7' and 8' are adapted to move substantially freely over the each other and the boot and are superimposed on each other in the flexion zone. According to a preferred arrangement, upper plate 8 is placed above and over the lower plate 7. Alternatively, lower plate 7 can be positioned over plate 8. Moreover, the free end or overlapping portions 7', 8' are provided with petal-shaped forms 11 adapted to conform to the morphology of the flexion zone of the boot and the foot in a very flexible manner. Overlapping portions 7 and 8 are sufficiently flexible and elastic so as to comprise means for substantially conforming to the shape of the foot in response to a force for holding the foot at the bottom of the boot that is produced by the holding means, e.g. a traction means such as a traction cable 12 or a strap. Traction cable 12, connected to the outside of the boot comprises a tightener whose action on the foot is diagrammed in FIGS. 2–5 by an arrow 13. The force of cable 12 passes above the covering zone of the two plates in the flexion zone of the foot and boot applied on the smallest edge of the heel according to a technique developed by the applicant, as will be discussed below. The covering zone and covering surface of plates 7 and 8 is the portion of each plate which overlaps the other plate. As will be discussed in more detail below with reference to FIGS. 2–5, according to the present invention cable 12 surrounds the covering zone of plates 7 and 8 and extends diagonally from the most hollow or curved portion of the flexion zone to the smallest edge of the heel, thereby defining a so-called "heel-instep perimeter".

FIGS. 2 and 5 illustrate the operation of the force distribution device. FIG. 2 illustrates distribution device in a rest position in which the tightening means produces substantially zero force on the plates. The support plate 8 is attached at its upper portion to the outer wall of inner boot 5 by a connection means 10 located on the external wall of the inner boot in the tibial support zone. Support plate 8 extends freely downward so as to simultaneously cover the flexion zone of the inner boot as well as the free portion of a second support plate 7 which itself also extends freely above said flexion zone. The other end of plate 7 is attached to inner boot 5 in the same manner as was previously described but at a point 9 on the top of the inner boot in the forward end zone thereof.

Plates 7 and 8 are preferably curved such that they conform at least partially to the curve of the flexion zone of the inner boot. It should be noted that upper plate 8 can have a radius of curvature greater than that of the lower plate 7 such that there exists an intermediate covering space or zone 15 between plate 7 and 8. However, this space 15 is not necessary to ensure the correct functioning of the device. In addition, according to one alternative embodiment of invention, the plates can also be connected to each other. Support plates 7, 8 can moreover, comprise extensions or lateral wings 16, 17, respectively, extending on each lateral side of the foot. Traction cable 12 is thus coiled above the covering zone and extends above lateral wings 16, 17 of said plates and toward the rear of the heel in the direction of the arrow 13.

FIG. 5 illustrates the distribution device when in use under the effect of a tightening force from cable 12. In FIG. 5 distribution device 6 is in its working position in which the tightening force for holding the foot at the bottom of the boot is greater than zero. FIG. 5 illustrates two working positions of device 6 corresponding to two different foot morphologies. The first foot morphology is illustrated by a first flexion zone morphology of the foot of a skier 18 and the second foot morphology is illustrated by a second flexion zone morphology 19 which is more pronounced than the first flexion zone morphology. These two diagrams of the two foot morphologies have been illustrated on the same figure so as to better illustrate the ability of the distribution device to adapt to flexion zones of different shapes for persons having a same shoe size.

According to the first case for a flexion zone 18 of the foot of the skier, distribution device 6 is narrowly applied on the top of the inner boot 5 to produce tightening forces for tightening the foot in the boot and holding the foot at the bottom of the boot. The resultant of these tightening forces is designed as $R_1$. The tension of traction cable 12 on the covering zone of the plates simultaneously provokes the flexion of the plates, respectively, around attachment point $O_1$ along the beginning of a trajectory $F_1$ for plate 8, and around point $O_2$ along the beginning of trajectory $F_2$ for plate 7. This flexion of plates 7, 8 is also accompanied by a sliding of their free ends 7', 8' over and with respect to one another.

The inner surfaces of said plates are adapted to conform to the top of the foot as is the inner boot. As the plates press against the inner boot, the flexible walls of the inner boot are sufficiently thick so as to compensate for the possible anatomical unequalness of the foot. The flexible wall of the inner boot is sufficiently thick and flexible so as to comprise means for compensating for feet having different anatomical shapes, especially in their flexion zones, in response to the tightening force being applied to distribution device 6. In effect, the tension of the traction cable causes the free ends 7' and 8' of the plates, which are rendered very supple by virtue of the petal-shaped construction 11, to conform to the upper surface of the inner boot. In addition, traction cable 12 causes the relative sliding of one of the plates over the other, so that the plates adjust themselves to the curvature of the flexion zone of the inner boot.

This narrow adaptation of the inner surfaces of support plates 7, 8 to the anatomy of a particular foot is clearly shown in the diagram of the flexion zone 19 in the same FIG. 5 wherein the curve of flexion zone 19 is definitely more pronounced than the preceding curve of flexion zone 18. In effect, the more pronounced curvature of flexion zone 19 produces a covering zone 15 of the plates having a smaller volume and a smaller length than the covering zone associated with a flexion zone 18 which has a less pronounced curvature. In this case, the tightening force of the cable, $R'_1$, simultaneously causes, the flexion of plates 7 and 8. Plate 8 pivots or flexes around anchoring point $O'_1$, and free end 8' of plate 8 travels across a portion of trajectory $F'_1$. Plate 7 pivots or flexes around point $O'_2$, and free end 7' of plate 7 travels across a portion of trajectory $F'_2$. It should be noted that due to the spacing of the contour of the flexion zone 19 with respect of the shell base, the portions of the trajectory $F'_1$ and $F'_2$ over which plates 7 and 8 travel are greater than the portions of trajectories $F_1$ and $F_2$ over which plates 7 and 8 travel when the foot has a flexion zone 18, as a result of flexion zone 18 having a less pronounced curve than flexion zone 19.

In all of these cases, the adaptation of the plates to the morphology of the particular flexion zone is further improved by the presence of lateral wings 16, 17 which are maintained against the inner boot by the lateral strands of the cable and, as a result, laterally enclose the foot. This lateral enclosing of the foot due to cable 18 increases the sensation of comfort of the foot in the boot.

The device according to the invention thus has the essential characteristic of effecting an inner tightening of the foot in the boot which is perfectly distributed and wherein the resultant $R_1$, $R'_1$ of the pressure forces of the foot always passes through the flexion zone located between the attachment points $O_1$-$O_2$, $O'_1$-$O'_2$, i.e., $R_1$, $R_1'$ pass through the curve itself of the flexion zone of the particular foot in the boot.

It should be noted, moreover, that this resultant of the tightening forces, created by traction cable 12, is substantially perpendicular to the adjacent covering surfaces of the free ends 7', 8' of the plates, which corresponds, in practice, to an automatic placement of cable 12 at the most hollow portion of the curve of the flexion zone of the foot, regardless of the morphology of the flexion zone or foot. The most hollow portion of the curve of the flexion zone of the foot is defined as that portion of the flexion zone which is the furthest distance from a straight line formed between two points at each extremities of the flexion zone of the foot.

Figure 6:
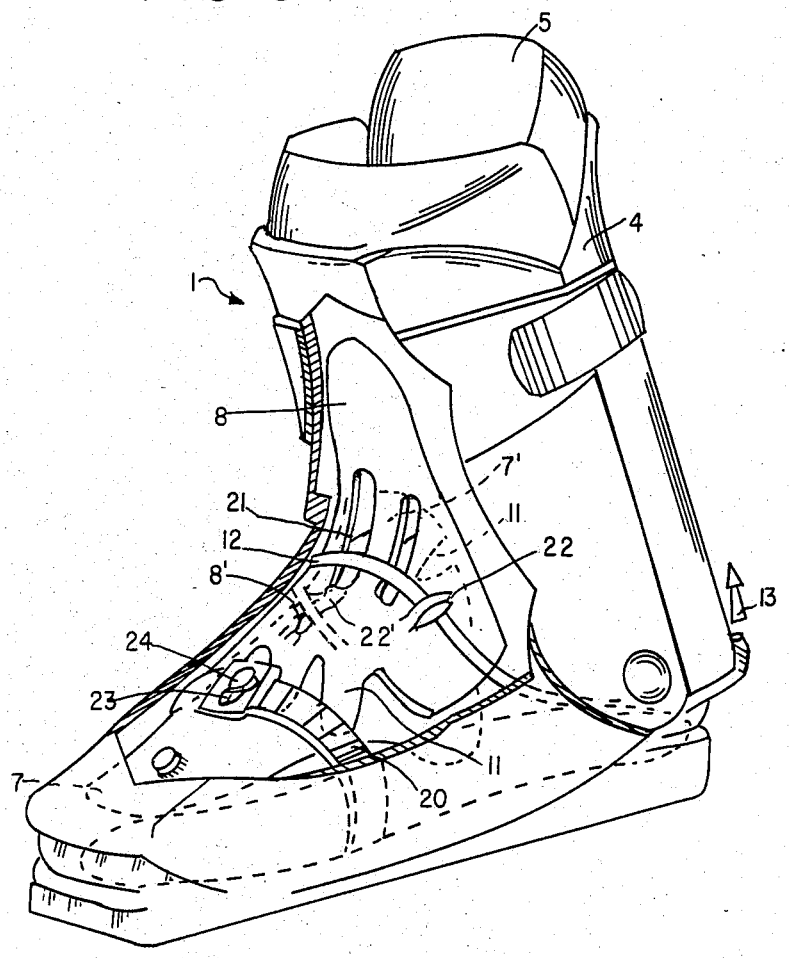
FIG. 6 illustrates a perspective view of an embodiment of the boot according to the present invention in which the device experiences the action of two tightening elements which also attach the support plates to the boot.

According to another embodiment seen in FIG. 6, free end 8' of support plate 8 can be extended forward so as to be maintained under a tightening device 20 on the front of the foot and boot, thereby causing a supplementary distribution of the tightening forces of the front of the foot. Moreover, slots 21 can also be provided in the instep zone or flexion zone of the plates to ensure the flexibility of said plates while at the same time maintaining a sufficient peripheral rigidity of the plates which is necessary to avoid the parasitic phenomenon of the "cord" effect during the tensioning of the cable 12.

Figure 11:
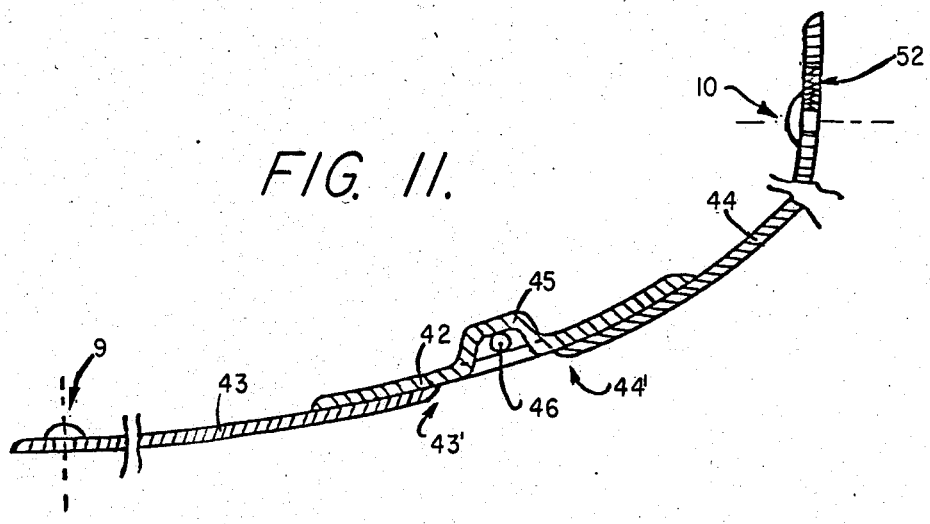

Another advantage of the distribution device according to the present invention is that the support plates of distribution device 6 are composed of elastic material so that they return to their initial position and shape (i.e., before tightening by cable 12) during their returning to a rest position when the tightening force ceases after having a value of greater than zero. Thus, the plates comprise elastic return means. This return to the plates' initial position and shape is due to the elasticity of the materials of which the plates are composed. This return to the initial position can also occur, as a result of the assistance of an additional element, elastic means 52, preferably located in the zone in which the plates are connected to the inner boot and/or the shell base, as is illustrated in FIG. 11.

It is also within the scope of the invention for each of support plates 7, 8 to be connected to the boot by means of tightening elements 12, 20 with which they cooperate as seen in FIG. 6. Plate 8 is connected to cable 12 by two lateral loops 22, 22' located on plate 8. The maintenance of the plates with respect to the cuff is thus conserved while allowing a lateral centering of the plate on the top of the foot. Of course, loops 22 will be sufficiently large to permit a sufficient movement of cable 12 to absorb variations in the curvature of the flexion zone.

In an analogous fashion, lower support plate 7 is connected to a strap 20 for the front foot portion comprising a longitudinal slot 23 located along the width of the strap. A small guiding projection 24 on plate 7 slides in slot 23. Projection 24 is molded with support plate 7 and is composed of flexible plastic.

Figure 7:
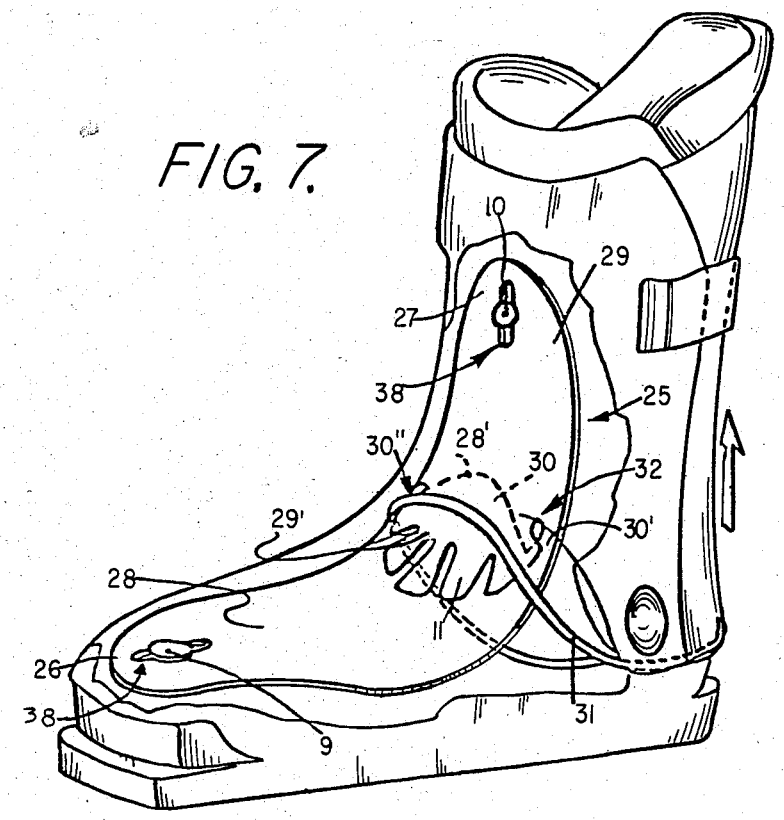

The present invention is not limited to the application of the two support plates distinct from one another, but also extends to embodiments which require distribution devices comprising, for example only a single plate, such as, for example, that illustrated in FIG. 7. This embodiment shows a single support plate 25 connected to the inner boot at its two ends 26 and 27 according to by connection means 9, 10, respectively, which have already been described. Connection means 9, 10 pass through longitudinal slots 38 in plate 25, which allow a certain adjustment or movement of connection means 9, 10. To permit the device to operate according to the principles of the present invention outlined above, this single plate has a curved surface, comprising, approximately at its central portion, a transverse opening 30. Plate 25 also comprises an upper plate portion 29 and a lower plate portion 28. Portion 29 comprises an upper skirt 29' and portion 28 comprises lower skit 28'. Skirts 28' and 29' overlap the entire flexion zone and define and are defined by transverse opening 30. The two plate portions 28 and 29 each possess their own bending characteristics independently of one another. Upper skirt 29' and lower skit 28' overlap one another and are connected to one another by continuous complete connection elements or zones 30', 30'' of plate 25. Elements 30, 30'' are located on each lateral side of plate 25. It will be noted that these continuous elements 30', 30'' are preferably of a narrow width and are composed of plastic material such that they ensure the bending of plate 25 by flexion of this plastic material. This single support plate has the characteristics of the embodiments of the present invention having two separate plates. These two plate portions overlap in the flexion zone and work in a fashion independent from each other, e.g. plate portions 28 and 29 flex and deform independently of one another. As a result of this flexing of portions 28 and 29 due to the tightening of traction element 31, upper skirt 29' slides on lower skirt 28'.

In order to further improve the deformation characteristics of continuous elements or zones 30', 30'', a notch 32 is provided on zones 30', 30'' to improve the sliding of the skirts. In addition, the skirts may be provided with deformation petals 11 described above and shown in FIG. 7.

The operation of this distribution device according to the present invention is analogous to that already described above and is due to the continuous elements or zones 30', 30'' which make the plate 25 a single unit element. It is also within the scope of the invention to have the continuous zones be composed of material that is different from that of the plate portions 29, 28. When this is the case, zones 30'', 30' can be attached to plates 28, 29 by sewing, gluing 33, etc., as seen in FIG. 8.

Figure 9:
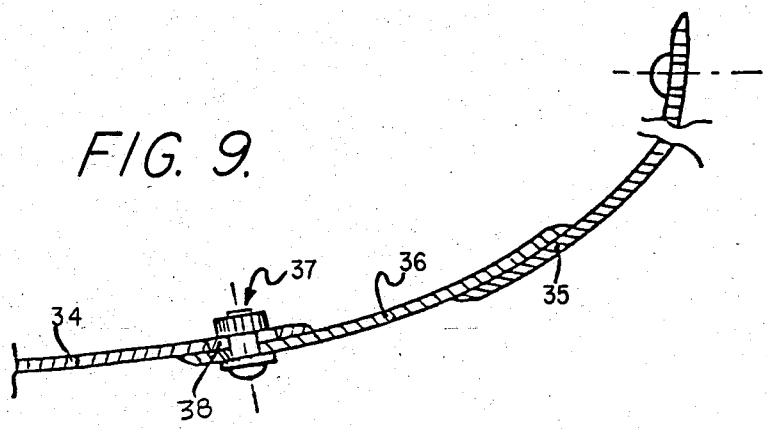
FIGS. 9 through 11 show various embodiments of the multiple support plates.
Figure 10:
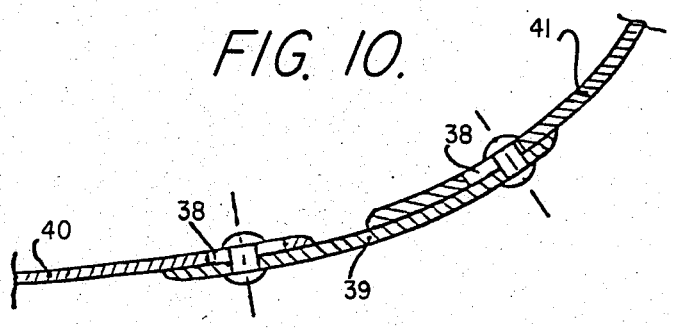

FIGS. 9 through 11 illustrate a cross-sectional view of a distribution device for distributing the inner tightening forces on the foot (illustrated by arrow 13 seen in FIG. 1) according to the present invention, comprising a multiplate type system which operates on a principle similar to the multiple blade spring or plate spring principle. In a multiple blade spring an upper plate is superimposed on a lower plate. As a result, the distance from the point at which the traction cable contacts the covering zone of the plates to the extremities of the plates is increased, thereby increasing the flexibility of the plate.

In FIG. 9 the lower support plate 34 is positioned above and over the upper plate 35. Plate 35 comprises an extension 36 whose position with respect to plate 34 is adjustable by means of an assembly element 37 adapted to slide in a slit 38 in plate 34 in a known fashion. For example, when element 37 is loosened, the position of extension 36 in slit 37 can be changed or adjusted along the longitudinal axis of the boot, so as to shorten or lengthen the support plates or the distribution device. This arrangement allows modification of the length of the support which is tensioned by the traction cable, independently from the flexion movements of the plates, according to the needs of the skier.

FIG. 10 illustrates another embodiment of the multiplate distribution device comprising a plate 39 intermediate the upper and lower plates 40, 41. In order to adapt; the plates to the curve of a particular flexion zone, intermediate plate 39 and/or the lower and upper plates 40, 41 are provided with sliding slits 38 through which plates 40, 41 are connected to plate 39 as is shown in FIG. 10. A connection means is adapted to pass through slits 38 to connect plate 39 to plates 40,41. As a result, the positions of plates 40, 41 along the vertical length of the inner boot can be changed to accommodate feet having flexion zones of different shapes. In addition, the position of the intermediate plate can be adjusted with respect to the longitudinal axis of the boot and the foot by the connection means being moved in the slits.

According to another embodiment, illustrated in FIG. 11, intermediate plate 42 is positioned above the free ends 43' and 44' of lower plate 43 and the upper plate 44, respectively. Lower plate 43 and upper plate 44 are themselves connected either to the inner boot or to the shell base, as was described previously. Preferably, this type of intermediate plate comprises an attachment means comprising a loop 45 in which traction cable 46 is engaged. In this figure, all tightening action by the cable is retransmitted in an already-distributed manner by intermediate plate 42.

Figure 12:
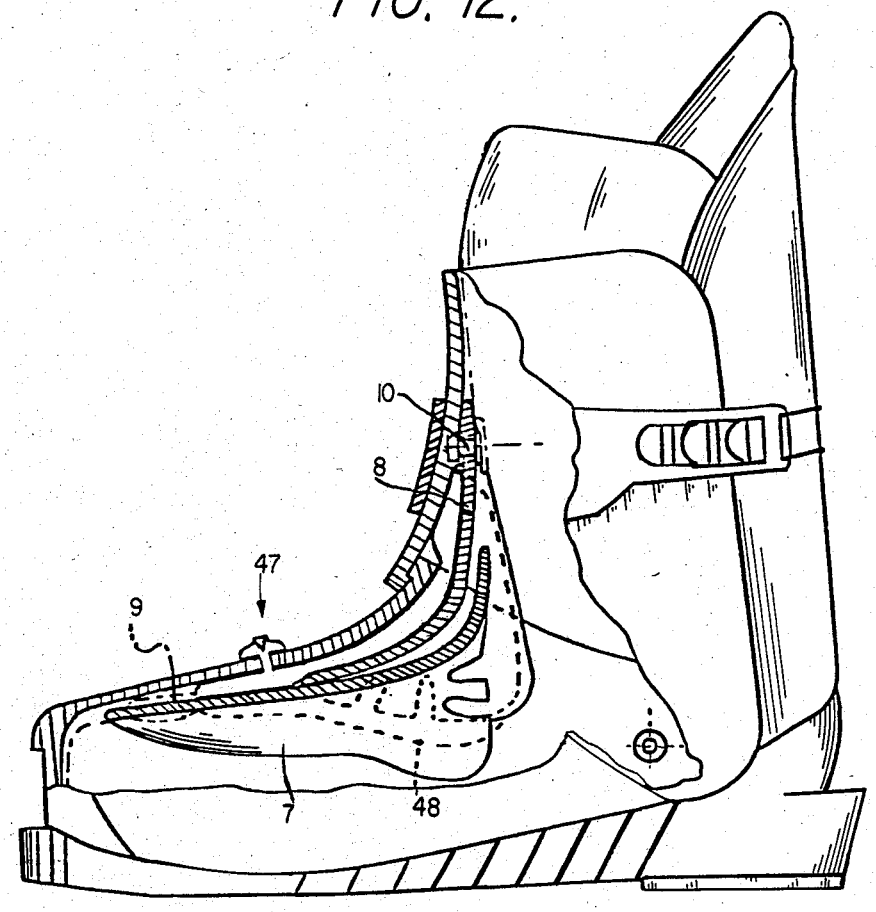
FIG. 12 illustrates an embodiment in which the tightening element acts by compression on the support plates of the distribution device.

Finally, the invention is not limited to the use of a traction element as a tightening element; it is within the scope of the invention to use a tightening element 47 acting by pressure or compression to exert a force between the shell base and the distribution device. For example, tightening element 47 could further comprise an inflatable chamber 48 having a liquid or gaseous fluid therein or filled with a viscous compound as illustrated in FIG. 12. Alternatively, tightening element could comprise adjustable compression springs, etc.

Figure 13:
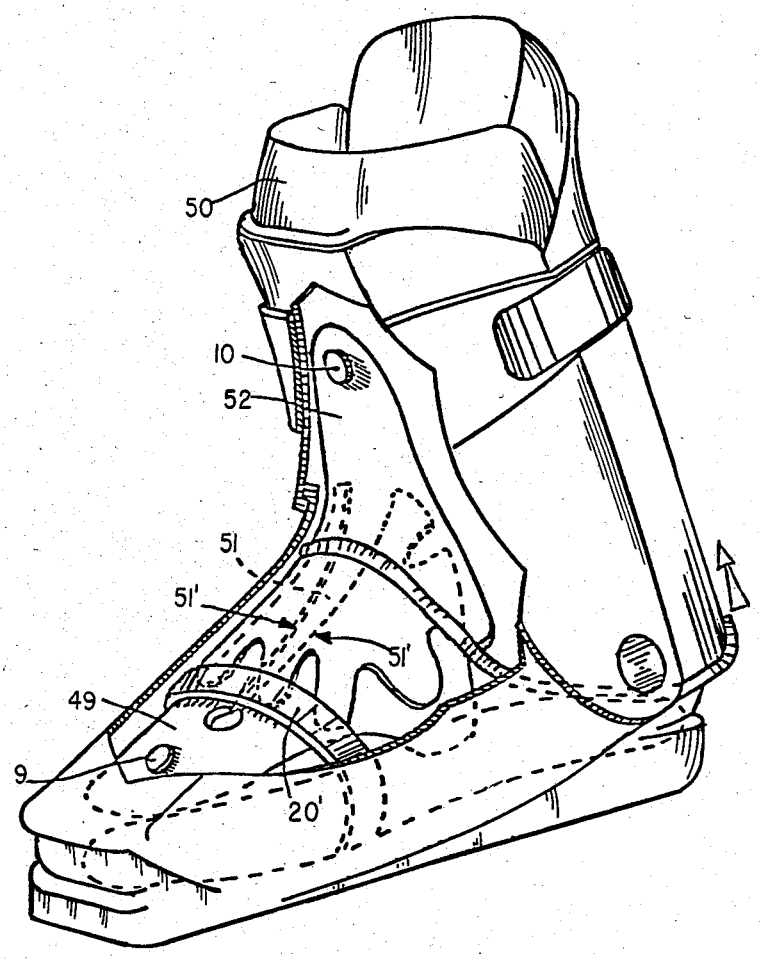
FIG. 13 illustrates an embodiment in which the adjustable support plate is adjustable to accommodate feet of different widths.

According to another embodiment of the present invention, the distribution device for distributing the internal tightening forces could comprise at least one adjustable support plate which is adjustable so as to accommodate feet of different widths. This embodiment is illustrated in FIG. 13. By way of the example, lower support plate 49 is attached to inner boot 50 by means 9, 10 and further comprises a V-shaped opening 51 located along the longitudinal axis of the boot. Upper plate 52 covers plate 49 according to the technique described above. This V-shaped opening ensures the correct tightening of the foot in the boot for feet and boots having instep of various widths and anatomies. Edges 51 of the opening are adapted to move closer together or further apart, depending on the width of the foot and can even overlap one another if the foot is narrow, or expand greatly for a very wide foot. Upper plate 52 which covers the lower plate retransmits the tightening force of cable 12 on the two plate portions separated by said opening 51. The edges of the V-shaped opening can have various contour forms (e.g. broken line, rounded, convex, etc.). The functioning of such a boot is analogous to that which was described above.

The invention is not limited to the embodiments and drawings described or illustrated, but also extends to embodiments combining these various embodiments as, for example, at the level of the attachment means of the plates or in their arrangement with respect with to one another.

Moreover, the multi-plate type distribution devices can be composed of different types of materials, according to the placement and the result to be achieved with regard to the comfort of the skier.

What is claimed is:

1. A ski boot having a bottom and adapted to hold a foot therein, wherein said boot comprises:

(a) holding means for producing a force for holding said foot at said bottom of said boot; and (b) distribution means for distributing said force over said foot, wherein said distribution means comprises at least two overlapping portions, wherein said distribution means further comprises means for varying the longitudinal extent of said two overlapping portions in response to the shape of the foot and/or said force from said holding means.

2. The ski boot defined by claim 1, wherein said boot further comprises an instep zone and a flexion zone, wherein said distribution means extends at least partially from said instep zone to said flexion zone of said boot.

3. The ski boot defined by claim 2, wherein said boot is adapted to hold a foot having a flexion zone, wherein said at least two portions overlap above said flexion zone of said foot.

4. The ski boot defined by claim 3, wherein said two overlapping portions are flexible and elastic.

5. The ski boot defined by claim 4 wherein said overlapping portions are sufficiently flexible so as to comprise means for substantially conforming to the shape of said foot in response to said force from said holding means being applied to said distribution means.

6. The ski boot defined by claim 5 wherein said boot further comprises an inner boot having an outer surface and an outer boot, wherein said overlapping portions are positioned on said outer surface of said inner boot.

7. The ski boot defined by claim 6 wherein said boot is adapted to accommodate feet of different anatomical shapes, wherein said inner boot further comprises a flexible wall comprising said outer surface wherein said flexible wall is sufficiently thick so that said flexible wall comprises means for compensating for feet having different anatomical shapes in response to said force being applied to said distribution means.

8. The ski boot defined by claim 3 wherein said distribution means comprises at least one plate.

9. The ski boot defined by claim 8 wherein said holding means comprises means for selectively applying said force to said distribution means.

10. The ski boot defined by claim 8 wherein said holding means comprises at least one means for tightening said foot in said boot.

11. The ski boot defined by claim 10 wherein said tightening means applies said force on said overlapping portions over said flexion zone of said boot.

12. The ski boot defined by claim 10 wherein said tightening means comprises traction means.

13. The ski boot defined by claim 12 wherein said traction means comprises a cable.

14. The ski boot defined by claim 12 wherein said traction means comprises a strap.

15. The ski boot defined by claim 10 wherein said boot further comprises a shell base and wherein said tightening means comprises compression means comprising an inflatable chamber positioned between said overlapping portions and said shell base.

16. The ski boot defined by claim 10 wherein said tightening means comprises a first tightening element positioned over said flexion zone of said boot and a second tightening element positioned over said instep of said boot in front of said first tightening element.

17. The ski boot defined by claim 10 wherein said distribution means comprises a first plate and a second plate, wherein said first plate comprises one of said overlapping portions and wherein said second plate comprises the other of said overlapping portions.

18. The ski boot defined by claim 17 wherein said first plate is integral with said one of said overlapping portions, and said second plate is integral with said other of said portions.

19. The ski boot defined by claim 18 wherein said boot comprises an upper and a base wherein said first plate is connected at a point on to said upper portion of said boot and said second plate is connected at a point on said base.

20. The ski boot defined by claim 19 wherein said upper comprises a cuff having an upper zone and said base comprises an end zone at one end of said base, wherein said first plate is connected to said upper zone of said cuff and said second plate is connected to said base in said end zone.

21. The ski boot defined by claim 20 wherein said first plate comprises an upper plate, wherein said second plate comprises a lower plate, wherein said upper plate overlaps said lower plate at least partially on top of said lower plate.

22. The ski boot defined by claim 20 wherein said second plate overlaps said first plate at least partially on top of said first plate.

23. The ski boot defined by claim 18 wherein said boot comprises an outer boot and an inner boot, wherein said plates are connected to said inner boot.

24. The ski boot defined by claim 18 wherein said boot comprises a cuff having an inner wall, wherein said plates are connected to said inner wall of said cuff.

25. The ski defined by claim 18 wherein said plates are clipped to said boot by a pressure-type button.

26. The ski boot defined by claim 18 wherein said at least one plate comprises a rack and said boot comprises a rack, adapted to engage said rack of said plate, wherein said plate is connected to said boot by the engagement of said rack of said boot with said rack of said plates.

27. The ski boot defined by claim 10 wherein said tightening means is adapted to be tightened and wherein said overlapping portions are adapted to be displaced substantially freely over each other in response to tightening of said tightening means.

28. The ski boot defined by claim 27 wherein said at least one plate plate is attached to said boot at at least on attachment point wherein said plate flexes around said attachment point in response to tightening of said tightening means.

29. The ski boot defined by claim 28 wherein each portion is petal-shaped.

30. The ski boot defined by claim 29 wherein said at least one plate further comprises at least one lateral wing.

31. The ski boot defined by claim 30 wherein the resultant of said force passes through said flexion zone of said foot and said overlapping portions each comprise a surface, wherein the resultant of said force is substantially perpendicular said surfaces of said overlapping portions.

32. The ski boot defined by claim 10 wherein said plate is a single plate and said overlapping portions are integral with said single plate, wherein said plate comprises a transverse opening defining said overlapping portions, each of which are adjacent said opening, wherein said boot comprises a cuff having an upper zone and a base having an end zone, wherein said plate comprises an upper end and a lower end, wherein said upper end of said plate is connected at a point on said upper zone of said cuff and said lower end of said plate is connected to a point on said end zone of said base.

33. The ski boot defined by claim 32 wherein said upper and lower end of said plate comprises a longitudinal slot, and wherein said boot further comprises connection means adapted to pass through said longitudinal slots to connect said plate to said boot, wherein said connection means is adapted to attach said plate to said boot at any point along the length of said longitudinal slot, whereby said plate is adapted to be displaced along the length of said slot.

34. The ski boot defined by claim 32 wherein said boot further comprises two flexible connection elements, each of which is disposed on one side of said transverse opening, wherein each connection element connects each of said overlapping portions to each other, wherein said connection elements comprise means for ensuring sliding of said overlapping portions over each other in response to tightening of said tightening means.

35. The ski boot defined by claim 34 wherein said connection elements each comprise a notch therein.

36. The ski boot defined by claim 10 wherein said boot comprises an upper part and a lower part distribution means comprises three separate support plate comprising an upper plate positioned on the upper part of said boot, a lower plate positioned on said lower part of said boot, and an intermediate plate, wherein said upper plate overlaps said intermediate plate to form a first covering zone comprising said overlap between said upper and intermediate plate, and wherein said intermediate plate overlaps said lower plate to form a second covering zone comprising said overlap between said intermediate and said lower plate.

37. The ski boot defined by claim 36 wherein said lower plate is positioned above said intermediate plate and wherein said intermediate plate is positioned above said upper plate.

38. The ski boot defined by claim 36 wherein said lower plate and said upper plate are positioned above said intermediate plate.

39. The ski boot defined by claim 36 wherein said intermediate plate is positioned above said upper and lower plates.

40. The ski boot defined by claim 36 wherein said intermediate plate comprises a lower end and an upper end, wherein said lower end is connected to said lower plate by connection means, wherein said connection means comprises means for adjusting the position of said intermediate plate along the longitudinal axis of said boot, wherein said upper end of said intermediate plate is adapted to be substantially freely displaced over said upper plate.

41. The ski boot defined by claim 36 wherein boot further comprises means for connecting said intermediate plate to said upper plate and means for connecting said intermediate plate to said lower plate, wherein both connecting means comprise means for adjusting of position of said intermediate plate with respect to the longitudinal axis of said boot, wherein said connecting means for said upper and lower plates comprise, slits in said upper and lower plates, respectively.

42. The ski boot defined by claim 36 wherein said intermediate plate is mounted for substantially free movement on top of said upper and lower plates wherein said intermediate plate is integral with said tightening means.

43. The ski boot defined by claim 42 wherein said boot further comprises connection means for connecting said intermediate plate with said tightening means, wherein said connection means comprises a loop on said intermediate plate through which said tightening means is adapted to pass.

44. The ski boot defined by claim 10 wherein said tightening means also comprises means for connecting said distribution means with said boot.

45. The ski boot defined by claim 10 wherein said distribution means is connected to said boot at a plurality of connection points, wherein said distribution means comprises adjustment slits which comprise said plurality of said connection points, wherein said slits comprise means for permitting said distribution means to be displaced along the longitudinal axis of said boot and said foot.

46. The ski boot defined by claim 10 wherein said distribution means is adapted to be placed in an initial position in which said force is zero, and said distribution means is adapted to be placed in a working position in which said force is greater than zero, wherein said boot further comprises means for connecting said boot with said distribution means, wherein said connecting means comprises elastic return means for returning said plate and said overlapping portions to said initial position when said tightening force ceases after having a value of greater than zero.

47. The ski boot defined by claim 10 wherein said overlapping portions each comprise a notched structure in the form of a petal.

48. The ski boot defined by claim 10 wherein said plate comprises flexible lateral wings on each lateral side of said foot.

49. The ski boot defined by claim 10 wherein said plate comprises flexible slits for ensuring the flexibility of said plate and maintaining the peripheral rigidity of said plate.

50. The ski boot defined by claim 10 wherein said distribution means comprises a lower and an upper plate, wherein said lower plate comprises a V-shaped notch adapted to permit said boot to accommodate feet of different widths.

51. The ski boot defined by claim 10 wherein said support plate is composed of plastic material which is flexible and elastic.

52. The ski boot defined by claim 10 wherein said distribution means comprises an upper and a lower plate, wherein said radius of curvature of one of said plates is greater than the radius of curvature of the other plate so that a covering space is produced between said portions.

53. The ski boot defined by claim 52 wherein said overlapping portion of said upper plate is positioned above said overlapping portion of said lower plate.

54. The ski boot defined by claim 10 wherein said boot further comprises an inner boot having an external wall and wherein said distribution means is connected to said external wall of said inner boot.

55. The ski boot defined by claim 10 wherein said boot further comprises a shell base having an internal wall, wherein said distribution means is connected to said internal wall said shell base.

56. A ski boot having a bottom and adapted to hold a foot therein, wherein said boot comprises:

(a) holding means for producing a force for holding said foot at said bottom of said boot;

(b) a first element for distributing said force over said foot; and (c) a second element for distributing said force over said foot, wherein said first and second elements each comprise first and second ends, wherein said first ends of said first and second elements are attached to said boot, wherein said second ends of said first and second elements are adapted to be displaced, wherein said first and second elements overlap each other over at least a portion of their extent.

57. A ski boot having a bottom and adapted to hold a foot therein, wherein said boot comprises:

(a) an outer boot;

(b) an inner boot inside said outer boot;

(c) holding means for producing a force for holding said foot at said bottom of said boot;

(d) a first element for distributing said force over said foot; and (e) a second element for distributing said force over said foot, wherein said first and second elements each comprise first and second ends, wherein said first ends of said first and second elements are attached to said inner boot, wherein said second ends of said first and second elements are free to be displaced, and wherein said first and second elements overlap each other over at least a portion of their extent.

58. A ski boot having a bottom and adapted to hold a foot therein, wherein said boot comprises:

(a) an outer boot;

(b) an inner boot inside said outer boot;

(c) holding means for producing a force for holding said foot at said bottom of said boot;

(d) a first element for distributing said force over said foot; and (e) a second element for distributing said force over said foot, wherein said first and second elements each comprise first and second ends, wherein said first end of said first element is attached to said inner boot, wherein said first end of said second element is attached to said outer boot, wherein said second ends of said first and second elements are adapted to be displaced, and wherein said first and second elements overlap each other over at least a portion of their extent.

* * * * *